US009058965B2

(12) United States Patent
Yang et al.

(10) Patent No.: US 9,058,965 B2
(45) Date of Patent: Jun. 16, 2015

(54) ION TRAP QUADRUPOLE MASS FILTER

(71) Applicant: Korea Basic Science Institute, Daejeon (KR)

(72) Inventors: Mo Yang, Daejeon (KR); Seung Yong Kim, Daejeon (KR); Hyun Sik Kim, Daejeon (KR)

(73) Assignee: Korea Basic Science Institute, Daejeon (KR)

( * ) Notice: Subject to any disclaimer, the term of this patent is extended or adjusted under 35 U.S.C. 154(b) by 12 days.

(21) Appl. No.: 14/097,848

(22) Filed: Dec. 5, 2013

(65) Prior Publication Data

US 2014/0158880 A1 Jun. 12, 2014

(30) Foreign Application Priority Data

Dec. 11, 2012 (KR) ..... 10-2012-0143703

(51) Int. Cl.
*H01J 49/42* (2006.01)
*H01J 49/06* (2006.01)

(52) U.S. Cl.
CPC ..... *H01J 49/065* (2013.01); *Y10T 29/49826* (2015.01); *H01J 49/424* (2013.01); *H01J 49/421* (2013.01)

(58) Field of Classification Search
CPC ..... H01J 49/147; H01J 49/424; H01J 49/421; H01J 49/4215
See application file for complete search history.

(56) References Cited

U.S. PATENT DOCUMENTS

| | | | | |
|---|---|---|---|---|
| 2001/0002696 | A1* | 6/2001 | Kato | 250/281 |
| 2004/0065824 | A1* | 4/2004 | Bateman et al. | 250/288 |
| 2009/0134321 | A1* | 5/2009 | Hoyes | 250/282 |

FOREIGN PATENT DOCUMENTS

| | | | |
|---|---|---|---|
| JP | 2000-106128 | A | 4/2000 |
| JP | 2009-295588 | A | 12/2009 |

* cited by examiner

*Primary Examiner* — Robert Kim
*Assistant Examiner* — Eliza Osenbaugh-Stewar
(74) *Attorney, Agent, or Firm* — Alston & Bird LLP

(57) ABSTRACT

An ion trap mass spectrometer is provided, including: an electron emitter; an ion trap storing ions generated by ionization resulting from an impact with electrons emitted from the electron emitter; a secondary ion filter for blocking out secondary ions generated due to ions selectively released by the ion trap; and a detector detecting ions selectively released from the ion trap, wherein the electron emitter, the ion trap, the secondary ion filter, and the ion detector are arranged on the same axis, so that a pure mass spectrum can be measured by excluding the secondary ions which are causes of background noise signals in the procedure of detection of the ions by the ion trap mass spectrometer.

11 Claims, 6 Drawing Sheets

ION TRAP QUADRUPOLE MASS FILTER

CROSS-REFERENCE TO RELATED APPLICATION

This application claims priority to and the benefit of Korean Patent Application No. 10-2012-0143703 filed in the Korean Intellectual Property Office on Dec. 11, 2012, the entire contents of which are incorporated herein by reference.

BACKGROUND OF THE INVENTION (a) Field of the Invention

The present invention relates to an ion trap mass spectrometer, and more particularly, to an ion trap mass spectrometer capable of improving mass resolution and detection sensitivity by detecting only ions sequentially released from an ion trap and excluding secondary ions generated out of the ion trap to measure a mass spectrum in the procedure of detection of the ions.

(b) Description of the Related Art

In general, an ion trap mass spectrometer is composed of a donut-shaped ring electrode and two end cap electrodes covering upper and lower portions of the ring electrode.

When an AC voltage is applied between the ring electrode and the two end cap electrodes covering the upper and lower portions of the ring electrode, a quadrupole is formed in the center inside since the two end cap electrodes are connected to each other at the same potential.

As for the simple principle of the ion trap mass spectrometer, a gas sample molecule is ionized by an electron beam, and then the ions are trapped in the thus formed quadrupole. When the AC voltage is increased to change the ion storage conditions, the lighter ions are first released in sequence, and the ion detector measures the released ions, thereby obtaining a mass spectrum showing components and a compositional ratio of the gas sample.

In order to allow the ions released from the ion trap to reach the ion detector, the ions are accelerated at a voltage of about 2000 V to impact on a surface of the ion detector. Here, electrons generated are amplified and then recorded as a current signal.

The accelerated ions impact with other molecules present on a path on which they reach the ion detector to form secondary ions, and secondary electrons are again reversely accelerated to cause another ionization. These procedures are repeated and thus an ion congestion phenomenon occurs.

Since the secondary ions are not ions released from the ion trap but are random ions generated on the path, they cause a difficulty in analyzing the contents of gas components, which are targeted by the mass spectrometer.

In order to remove the secondary ion noise signal, the ion congestion phenomenon is reduced by forming a middle electrode for ion warping between an outlet of the ion trap and the ion detector to thereby allow the secondary ions to deviate from the path, or the background ion noise signal is reduced by forming an ion lens in the middle and applying a pulse type of voltage thereto. However, these methods are not significantly useful.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide an ion trap mass spectrometer having advantages of measuring a pure mass spectrum free from background noise signals, by forming a quadrupole potential well between an ion trap and an ion detector to prevent secondary ions, which are newly generated on a path out of an ion trap, from reaching the ion detector and allowing only ions, which are released from the ion trap by mass scanning, to reach the ion detector.

An exemplary embodiment of the present invention provides an ion trap mass spectrometer, including: an electron emitter; an ion trap storing ions generated by ionization resulting from an impact with electrons emitted from the electron emitter; a secondary ion filter for blocking out secondary ions generated due to ions selectively released by the ion trap; and a detector detecting ions selectively released from the ion trap, wherein the electron emitter, the ion trap, the secondary ion filter, and the ion detector are arranged on the same axis.

According to an embodiment of the present invention, a pure mass spectrum can be measured by excluding the secondary ions which are causes of background noise signals in the procedure of detection of the ions by the ion trap mass spectrometer.

According to an embodiment of the present invention, the mass resolution can be improved by preventing an ion congestion phenomenon resulting from secondary ionization to prevent the ion signal peak from being widened.

Further, since the background noise signals due to the secondary ionization are excluded, a trace amount of pure ions can be detected and thus the signal detection range (dynamic range) of the mass spectrum can be widened.

DETAILED DESCRIPTION OF THE EMBODIMENTS

Figure 1:
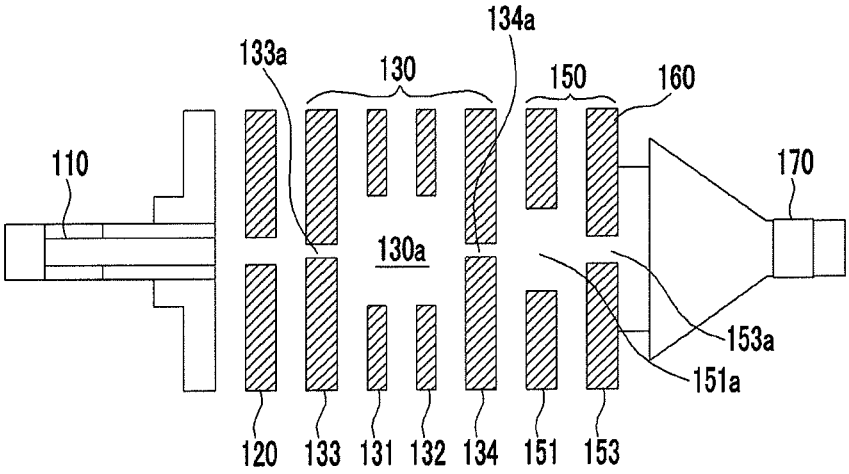
FIG. 1 is a schematic cross-sectional view illustrating a structure of an ion trap mass spectrometer according to an exemplary embodiment of the present invention.

Hereinafter, exemplary embodiments of the present invention will be described more fully with reference to the accompanying drawings. First, concerning the designations of reference numerals, it should be noted that the same reference numerals are used throughout the different drawings to designate the same or similar components. Further, in the description of the present invention, when it is considered that detailed descriptions of related known constitutions or functions may obscure the gist of the present invention, such detailed descriptions are omitted.

Figure 2:
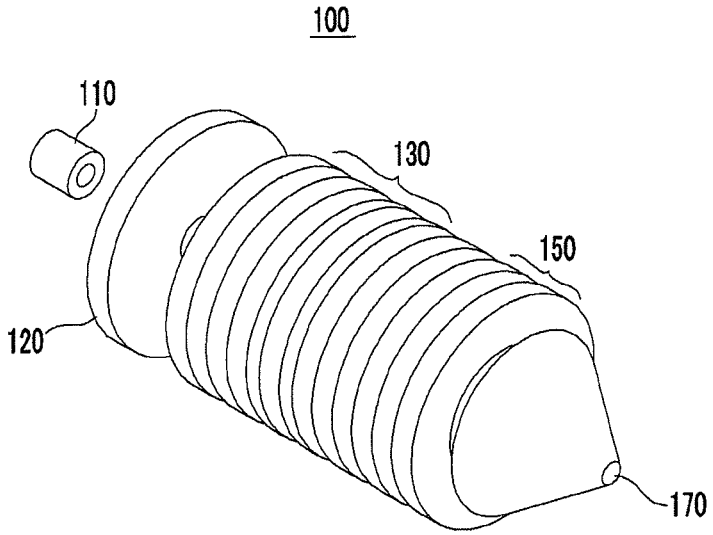
FIG. 2 is a schematic perspective view illustrating an external appearance of an ion trap mass spectrometer according to an exemplary embodiment of the present invention.

FIG. 1 is a schematic cross-sectional view illustrating a structure of an ion trap mass spectrometer according to an exemplary embodiment of the present invention, and FIG. 2 is a schematic perspective view illustrating an external appearance of an ion trap mass spectrometer according to an exemplary embodiment of the present invention.

As shown in FIG. 1, an ion trap mass spectrometer 100 according to an embodiment of the present invention includes an electron emitter 110, an ion trap 130, a secondary ion filter 150, and an ion detector 170, which are disposed on the same axis.

The electron emitter 110 may be a hot filament that is heated by a current supplied from a battery, although not shown, to emit hot electrons. The emitted hot electrons pass through an electron focusing lens 120 disposed between the electron emitter 110 and the ion trap 130, and then enters the ion trap 130.

The ion trap 130 consists of a pair of plate-type ring electrodes 131 and 132 and a pair of plate-type end cap electrodes 133 and 134. The plate-type ring electrodes 131 and 132 are spaced apart from each other at a predetermined interval to face each other, and the plate-type end cap electrodes 133 and 134 are respectively disposed at one side of each of the pair of plate-type ring electrodes 131 and 132 and spaced apart from each other at a predetermined interval to face each other.

The pair of plate-type ring electrodes 131 and 132 and the pair of plate-type end cap electrodes 133 and 134 are formed to be planar such that their facing opposite surfaces confront each other. A first aperture 133*a* is formed in the center of a first end cap electrode 133 of the pair of plate-type end cap electrodes 133 and 134. The first aperture 133*a* is an inlet through which hot electrons emitted from the electron emitter 110 enter the ion trap 130.

A second aperture 134*a* is formed in the center of a second end cap electrode 134 of the pair of plate-type end cap electrodes 134 and 134. The first aperture 133*a* and the second aperture 134*a* are disposed on the same axis and have the same diameter. The second aperture 134*a* is an outlet through which the ions separated from the first aperture 130*a* of the ion trap 130 emit.

The secondary ion filter 150 is disposed between the ion trap 130 and the ion detector 170. The secondary ion filter 150 consists of a plate-type ion filtering ring electrode 151 facing the second end cap electrode 134 of the ion trap 130 and a plate-type ion filtering end cap electrode 153 facing the plate-type ion filtering ring electrode 151.

The second end cap electrode 134 of a plate type serves to form a quadrupole 151*a* together with the plate-type ion filtering ring electrode 151 and the plate-type ion filtering end cap electrode 153 of the secondary ion filter 150. The second aperture 134*a* formed in the center of the second end cap 134 is used as both an outlet from the ion trap 130 and an inlet through which ions flow to the secondary ion filter 150.

Of ions coming out from the ion trap 130, secondary ions are filtered by the secondary ion filter 150.

For achieving this, the ion filtering end cap electrode 153 of the secondary ion filter 150 is provided with a third aperture 153*a* in the center thereof. The third aperture 153*a* has a larger diameter than the second aperture 134*a* formed in the second end cap electrode 134.

As such, the ion trap mass spectrometer 100 according to an exemplary embodiment of the present invention can have a slim and compact design since both the ion trap 130 and the secondary ion filter 150 are formed as a plate type.

In addition, a diaphragm 160 for controlling the diameter of the third aperture 153*a* is further provided between the ion filtering end cap electrode 153 and the ion detector 170, so that the signal detection range (dynamic range) of a mass spectrum can be diversified even without changing the voltage applied to the ion filtering ring electrode 151.

Now, referring to FIGS. 3A to 4, an operational principle of the ion trap mass spectrometer according to an exemplary embodiment of the present invention will be described.

Figure 3A:
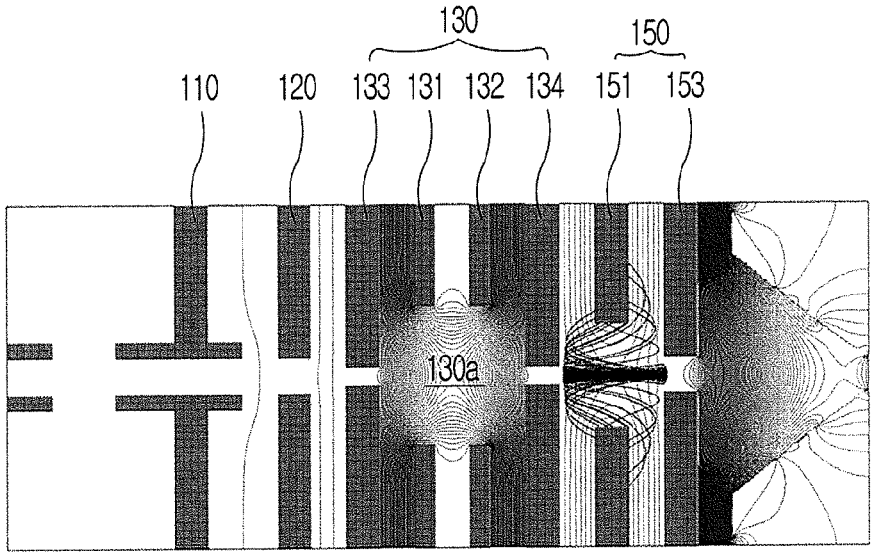
FIG. 3A and FIG. 3B are conceptual views illustrating an operational principle of a secondary ion filter included in an ion trap mass spectrometer according to an exemplary embodiment of the present invention, and are obtained by simulating and computing moving paths in the secondary ion filter of ions, which are generated due to secondary ionization occurring between an ion tap and an ion detector by a voltage of a secondary ion filtering ring electrode, and ions, which are released due to AC scanning in the ion trap to form a mass spectrum.
Figure 3B:
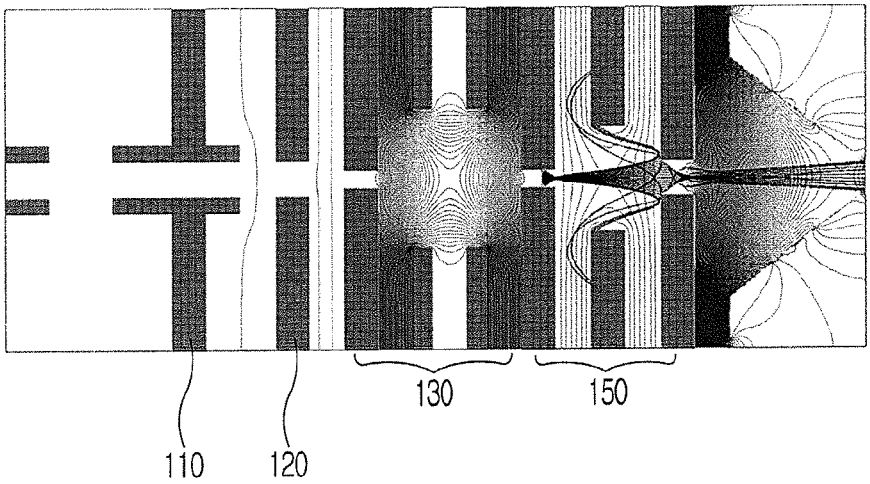

FIG. 3A and FIG. 3B are conceptual views illustrating an operational principle of a secondary ion filter included in an ion trap mass spectrometer according to an exemplary embodiment of the present invention, and are obtained by simulating and computing moving paths in the secondary ion filter of ions which are generated due to a secondary ionization occurring between an ion tap and an ion detector by a voltage of an ion filtering ring electrode, and ions which are released due to AC scanning in the ion trap to form a mass spectrum. FIG. 4 is a potential distribution diagram of an ion trap mass spectrometer according to an exemplary embodiment of the present invention. FIG. 5 is a flowchart illustrating a secondary ion excluding method of an ion trap mass spectrometer according to an exemplary embodiment of the present invention.

As shown in FIG. 3A, electrons emitted from the electron emitter 110 are focused by the electron focusing lens 120 to enter the ion trap 130 through the first aperture 133*a* of the first end cap electrode 133, and then impact with and ionize the gas present in a space in the ion trap 130 (impact ionization). As the RF (radio frequency) voltage applied to the pair of plate-type ring electrodes 131 and 132 is increased, the ionized materials are sequentially discharged through the second aperture 134*a* of the second end cap electrode 134, from the lighter ions to the heavier ions.

Here, a quadrupole is formed inside the secondary ion filter 150 by applying a first voltage to the plate-type ion filtering end cap electrode 153 of the secondary ion filter 150, which is further disposed between the ion trap 130 and the ion detector 170, and applying a second voltage to the plate-type ion filtering ring electrode 151 of the secondary ion filter 150, the first voltage being equal to the voltage applied to the second end cap electrode 134 of the ion trap 130, the second voltage being lower than the first voltage.

The voltage applied to the plate-type ion filtering ring electrode 151 may be a negative (−) voltage.

Between the second end cap electrode 134 of the ion trap 130 and the ion filtering end cap electrode 153 of the secondary ion filter 150, the secondary ions generated due to an impact with ions emitted through the second aperture 134*a* of the second end cap electrode 134 are pulled toward the ion filtering ring electrode 151, and then discharged out of the mass spectrometer instead of being moved to the detector, as shown in FIG. 3A. The ions released from AC scanning of the ion trap move to the detector as shown in FIG. 3B. Therefore, a mass spectrum excluding noise signals and having improved resolution can be recorded.

For achieving this, a ground unit 155 for grounding the secondary ions pulled toward the ion filtering ring electrode 151 may be further provided at the ion filtering ring electrode 151.

Figure 4:
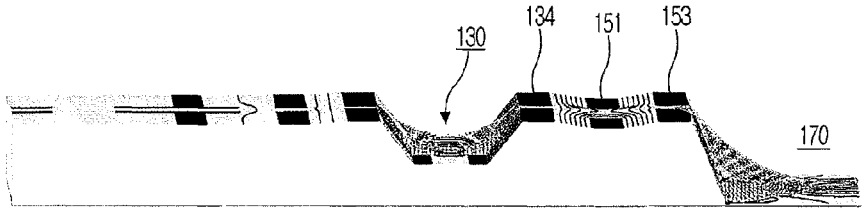
FIG. 4 is a potential distribution diagram of an ion trap mass spectrometer according to an exemplary embodiment of the present invention.
Figure 5:
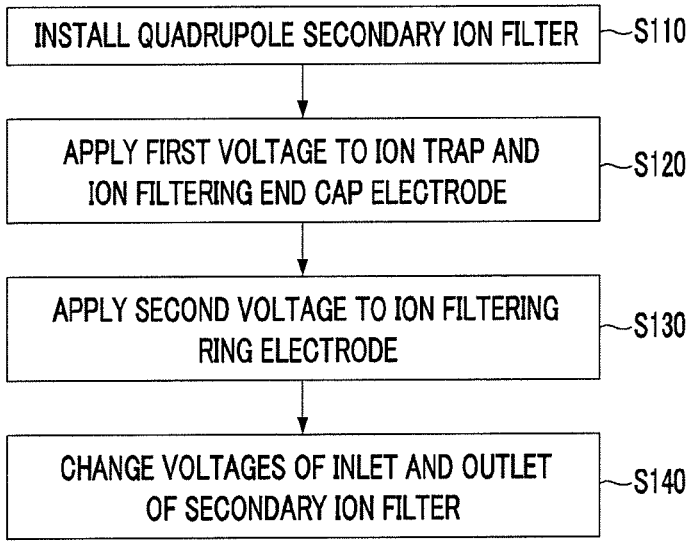
FIG. 5 is a flowchart illustrating a secondary ion excluding method of an ion trap mass spectrometer according to an exemplary embodiment of the present invention.

The reason is that, since the diameter of the third aperture 153*a* of the ion filtering end cap electrode 153 is slightly larger than the diameter of the second aperture 134*a* of the second end cap electrode 134 while the second end cap electrode 134 and the ion filtering end cap electrode 153 have the same potential, the potential at the center axis of an outlet of the third aperture 153*a* of the ion filtering end cap electrode 153 is slightly lower than the potential at the center axis of an outlet of the second aperture 134*a* of the second end cap electrode 134, as shown in FIG. 4.

Therefore, as shown in FIG. 3B, the ions leaking out from the ion trap 130 through the second aperture 134*a* of the second end cap electrode 134 are accelerated toward a center portion of the ion filter 150 along the potential slope of the quadrupole 150*a* of the ion filter 150, and are decelerated after the center portion and then pass through the secondary ion filter 150 through the third aperture 153*a* of the ion filtering end cap electrode 153. However, the secondary ions generated due to the impact with ions released through the second aperture 134*a* of the second end cap electrode 134 are generated inside of the ion filter 150, that is, at the site of which the potential is low, and thus cannot go over the potential at the center axis of the outlet of third aperture 153*a* of the ion filtering end cap electrode 153.

Hereinafter, a secondary ion excluding method of an ion trap mass spectrometer according to an exemplary embodiment of the present invention will be described with reference to FIG. 5.

The secondary ion excluding method of an ion trap mass spectrometer according to an exemplary embodiment of the present invention includes a step of installing a quadrupole secondary ion filter between an ion trap and an ion detector of an ion trap mass spectrometer having a quadrupole ion trap (S110).

The quadrupole secondary ion filter 150 may consist of a plate-type ion filtering ring electrode 151 and a plate-type ion filtering end cap electrode 153.

A first voltage is applied to the plate-type ion filtering end cap electrode of the quadrupole secondary ion filter 150, the first voltage being equal to that of the end cap electrode of the ion trap (S120).

The first voltage is a DC voltage.

A second voltage is applied to the plate-type ion filtering ring electrode 151 of the quadrupole secondary ion filter 150 to form a quadrupole inside the secondary ion filter 150, the second voltage being lower than the first voltage (S130). The second voltage may be a negative voltage.

The secondary ion excluding method of an ion trap mass spectrometer according to an exemplary embodiment of the present invention includes a step of changing voltages of an inlet and an outlet of the quadrupole secondary ion filter 150 (S140).

As described above, in the step of changing the voltages of the inlet and the outlet of the quadrupole secondary ion filter 150, the difference between the voltages may be decreased by differentiating the diameters of the inlet and the outlet of the quadrupole secondary ion filter 150.

Therefore, the ion trap mass spectrometer 100 according to an exemplary embodiment of the present invention can measure a pure mass spectrum since the secondary ions resulting in the background noise signal are excluded by the second ion filter 150.

Further, the mass resolution can be improved by preventing an ion congestion phenomenon resulting from secondary ionization and thus preventing the ion signal peak from being widened.

Further, since the background noise signals due to the secondary ionization are excluded, a trace amount of pure ions can be detected and thus the signal detection range (dynamic range) of the mass spectrum can be widened in spite of a small and slim constitution.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

| <Description of Symbols> | |
|---|---|
| 110: electron emitter | 120: electron focusing lens |
| 130: ion trap mass spectrometer | 150: ion filter |
| 160: diaphragm | 170: ion detector |

What is claimed is:

1. An ion trap mass spectrometer, comprising: an electron emitter;

an ion trap storing ions generated by ionization resulting from an impact with electrons emitted from the electron emitter;

a secondary ion filter for blocking out secondary ions generated due to ions selectively released by the ion trap; and a detector detecting ions selectively released from the ion trap, wherein the electron emitter, the ion trap, the secondary ion filter, and the ion detector are arranged on the same axis;

wherein the secondary ion filter consists of a plate-type ion filtering ring electrode and a plate-type ion filtering end cap electrode disposed to face the plate-type ion filtering ring electrode.

2. The ion trap mass spectrometer of claim 1, wherein the ion trap and the secondary ion filter form a quadrupole inside the secondary ion filter.

3. The ion trap mass spectrometer of claim 2, wherein the ion trap consists of a pair of plate-type ring electrodes, which are spaced apart from each other at a predetermined interval to face each other, and a pair of plate-type end cap electrodes, which are respectively disposed at sides of the pair of plate-type ring electrodes and spaced apart from each other at a predetermined interval to face each other, the quadrupole being formed inside the secondary ion filter at the time of applying an AC voltage to the ring electrode and the end cap electrode, and wherein the ion trap selectively releases ions according to the mass when the voltage of the ring electrode is changed.

4. The ion trap mass spectrometer of claim 3, wherein the pair of plate-type ring electrodes and the pair of plate-type end cap electrodes are formed to be planar such that their facing opposite surfaces confront each other, a first aperture being formed in a center of a first end cap electrode of the pair of plate-type end cap electrodes and a second aperture being formed in a center of a second end cap electrode thereof, the first aperture and the second aperture being formed on the same axis.

5. The ion trap mass spectrometer of claim 1, wherein the secondary ion filter is disposed between the ion trap and the ion detector.

6. The ion trap mass spectrometer of claim 1, wherein when a first voltage is applied to the plate-type second end cap electrode of the ion trap and the plate-type ion filtering end cap electrode of the secondary ion filter and a lower voltage than the first voltage is applied to the ion filtering ring electrode, a quadrupole is formed inside the secondary ion filter.

7. The ion trap mass spectrometer of claim 6, wherein the ion filtering end cap electrode of the secondary ion filter has a third aperture having a larger diameter than the second aperture formed in the second end cap electrode.

8. The ion trap mass spectrometer of claim 7, wherein the secondary ion filter further includes a diaphragm changing the diameter of the third aperture of the ion filtering end cap electrode, and a ground unit for grounding secondary ions collected in the ion filtering ring electrode.

9. A method for excluding detection of secondary ions in an ion trap mass spectrometer, the method comprising installing a quadrupole ion filter between an ion trap and an ion detector of the ion trap mass spectrometer to prevent secondary ions generated out of the ion trap from reaching the ion detector, wherein the quadrupole ion filter includes two plate-type electrodes each having a hole in a center thereof.

10. The method of claim 9, further comprising differentiating voltages of an inlet and an outlet of the quadrupole ion filter.

11. The method of claim 10, wherein the differentiating of the voltages includes: inducing a voltage difference by making a diameter of the outlet of the quadrupole ion filter slightly larger than a diameter of the outlet of the ion trap; and applying a negative voltage to one of the two plate-type electrodes, which is adjacent to the ion trap.

* * * * *